US007657213B2

(12) United States Patent
Baker et al.

(10) Patent No.: US 7,657,213 B2
(45) Date of Patent: Feb. 2, 2010

(54) DOCTOR BLADE WITH TANGENTIAL WORKING TIP

(75) Inventors: Ronald Willard Baker, Versailles, KY (US); Ligia Aura Bejat, Versailles, KY (US); Michael Craig Leemhuis, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 119 days.

(21) Appl. No.: 11/434,600

(22) Filed: May 15, 2006

(65) Prior Publication Data

US 2007/0264056 A1 Nov. 15, 2007

(51) Int. Cl.
*G03G 15/08* (2006.01)

(52) U.S. Cl. ..... 399/284

(58) Field of Classification Search ..... 399/274, 399/275, 284, 265, 267, 279
See application file for complete search history.

(56) References Cited

U.S. PATENT DOCUMENTS 4,920,916 A * 5/1990 Mizuno et al. ..... 399/284
5,185,632 A * 2/1993 Yoshida et al. ..... 399/284
5,587,551 A * 12/1996 Ikegawa et al. ..... 399/284
6,021,299 A * 2/2000 Hansburg et al. ..... 399/284
6,064,463 A * 5/2000 Yamada et al. ..... 355/27
6,603,944 B2 * 8/2003 Tatsumi ..... 399/284
7,082,280 B2 * 7/2006 Kim ..... 399/274
7,236,729 B2 * 6/2007 Askren et al. ..... 399/284
2004/0091290 A1 * 5/2004 Yamada et al. ..... 399/284
2007/0189814 A1 * 8/2007 Gayne et al. ..... 399/284

FOREIGN PATENT DOCUMENTS

JP 08185045 A * 7/1996
JP 09062096 A * 3/1997
JP 09138566 A * 5/1997
JP 2001109259 A * 4/2001

* cited by examiner

*Primary Examiner*—Robert Beatty
(74) *Attorney, Agent, or Firm*—Timothy N. Trop

(57) ABSTRACT

A doctor blade for a printer may include a cantilever spring. The free end of the cantilever spring includes a section with a first bend in one direction and a second bend in the opposite direction. Thus, a bump end may be formed which has a surface which is generally tangential to the surface of a developer roll against which the doctor blade is biased.

18 Claims, 2 Drawing Sheets

DOCTOR BLADE WITH TANGENTIAL WORKING TIP

BACKGROUND

This invention relates generally to electro-photographic printers that use toner to transfer an image to a medium.

In conventional electrophotographic printing, toner is transferred from a developer roll to a photoconductive surface and eventually to a medium. In order to obtain a good transfer of the image, it is desirable that the toner on a developer roll be applied very evenly. Even application of toner may be facilitated by using a doctor blade that controls the thickness of the toner on the developer roll. As the developer roll rotates, the doctor blade doctors the toner applied thereto and provides a relatively uniform toner coating.

Since the application of the uniform toner coating may be critical to the performance of the printer, there is a continuing need for better doctor blade designs.

DETAILED DESCRIPTION

Figure 1:
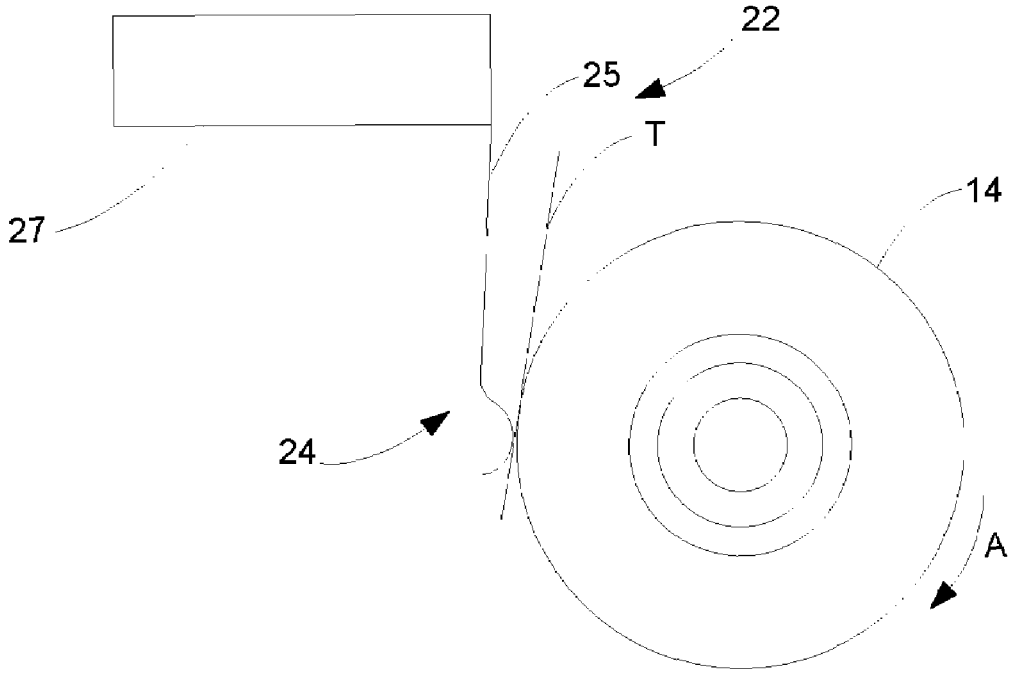
FIG. 1 is a partial, cross-sectional view of one embodiment of the present invention in a loaded configuration.

Referring to FIG. 1, a developer roll 14 rotates in the direction indicated by the arrow A. The developer roll 14 may be covered with a layer of toner (not shown). Biased against the surface of the developer roll 14 is a doctor blade 22. In one embodiment of the present invention, the doctor blade 22 is a thin, highly resilient metallic sheet that acts as a cantilevered leaf spring. For example, the doctor blade 22 may be made of stainless steel in one embodiment of the present invention. The blade 22 may have a curved end 24. While a bump-shaped end 24 is shown in FIG. 1, other end designs may be utilized as well.

As the developer roll 14 rotates in the direction indicated by A, the uneven toner layer on the surface of the developer roll contacts the end 24 of the doctor blade 22 and is doctored off or squeezed into the nip between the end 24 and the roll 14, providing a uniform thickness toner layer on the output, clockwise, or downstream side of the doctor blade 22.

The doctor blade 22 may be supported in a spring biased configuration against the surface of the developer roll 14 through the application of a counterclockwise moment applied by a mounting bracket 27.

The mounting bracket 27 is coupled to the end 24 through a cantilever spring portion 25. The portion 25 provides a cantilever spring force biasing the end 24 against the developer roll 14.

Figure 2:
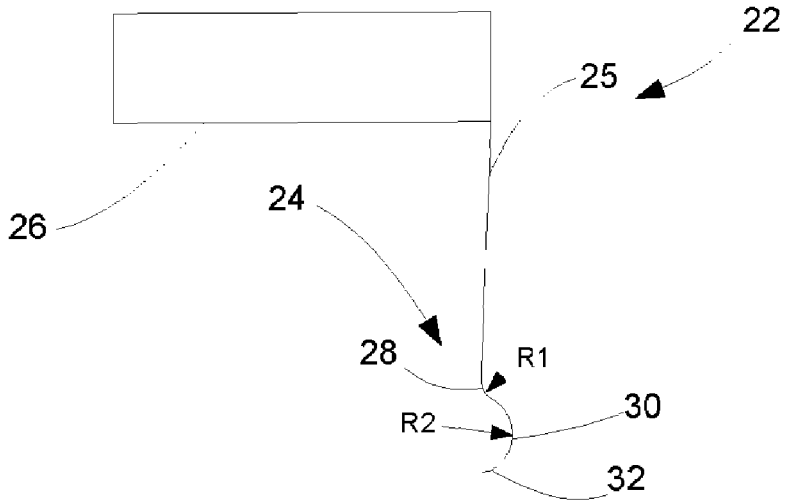
FIG. 2 is an exploded depiction of the embodiment of FIG. 1 in a loaded configuration.

Referring to FIG. 2, the doctor blade in its loaded position is shown. There it can be seen that the end 24 is formed by a first counterclockwise bend 28, a second clockwise bend 30 to a tip 32 which, in one embodiment, may be substantially aligned with the length of the portion 25. In one embodiment, the radius of curvature R2 of the second bend is larger than the radius of curvature R1 of the first bend. For example, the second bend radius of curvature R2 may be between 0.2 mm and 1.4 mm and, more preferably, between 0.5 mm and 0.9 mm.

Referring back to FIG. 1, it can be seen that the blade 22 contacts the developer roll 14 at a point on bend 30. Further, as indicated in FIG. 1, the bend 30 defines a contact surface which is substantially tangential with the surface of the developer roll 14 as indicated by the tangent line T. Control of the second bend radius is critical to the proper function of this design.

Thus, it can be seen that the tip 32 of the blade 22 may be generally aligned with the axis of the developer roll 14. Moreover, the tip 32 does not contact the developer roll 14. Therefore, the orientation between the tip 32 and the developer roll 14 is less critical to operation of the doctor blade. Since the alignment between the end and the axis of the developer roll 14 may be difficult to control, in some embodiments, this critical parameter has been eliminated.

The doctor blade 22 may not require that the blade cantilever length be tightly controlled. Since this dimension is contained entirely within the doctor blade itself, it may not cause an assembly tolerance issue in some embodiments.

Moreover, the pressure of the blade 22 against the developer roll 14 is uniform along the length of the blade to avoid print defects. A flat doctor blade without the end 24 is not very stiff. Checkmark doctor blade designs tend to be 50 to 150 times stiffer than a flat blade. The blade shown in FIG. 1 may have a stiffness value of approximately 5 times larger than a flat blade, providing advantages, in some embodiments of the present invention, over the checkmark blade. Reducing stiffness may be important in manufacturing the part in that the straightness of the form is less critical and, thus, easier to manufacture with a conforming blade.

The first bend 28 allows the blade to operate in a position that is essentially tangent to the developer roll 14, unlike a checkmark blade that operates at an acute angle to the developer roll 14. The tangential orientation of the blade 22 reduces the blade stiffness in the radial direction for a given beam length, thickness, and modulus of elasticity. Uniform contact pressure between the doctor blade and the developer roll is critical to print quality. This can be achieved by minimizing the cross-sectional area moment of inertia of the doctor blade which, in turn, reduces the longitudinal stiffness of the blade. This allows the blade to conform to the surface of the developer roller and minimizes sensitivity to longitudinal part straightness. This feature results in a more robust design.

Figure 3:
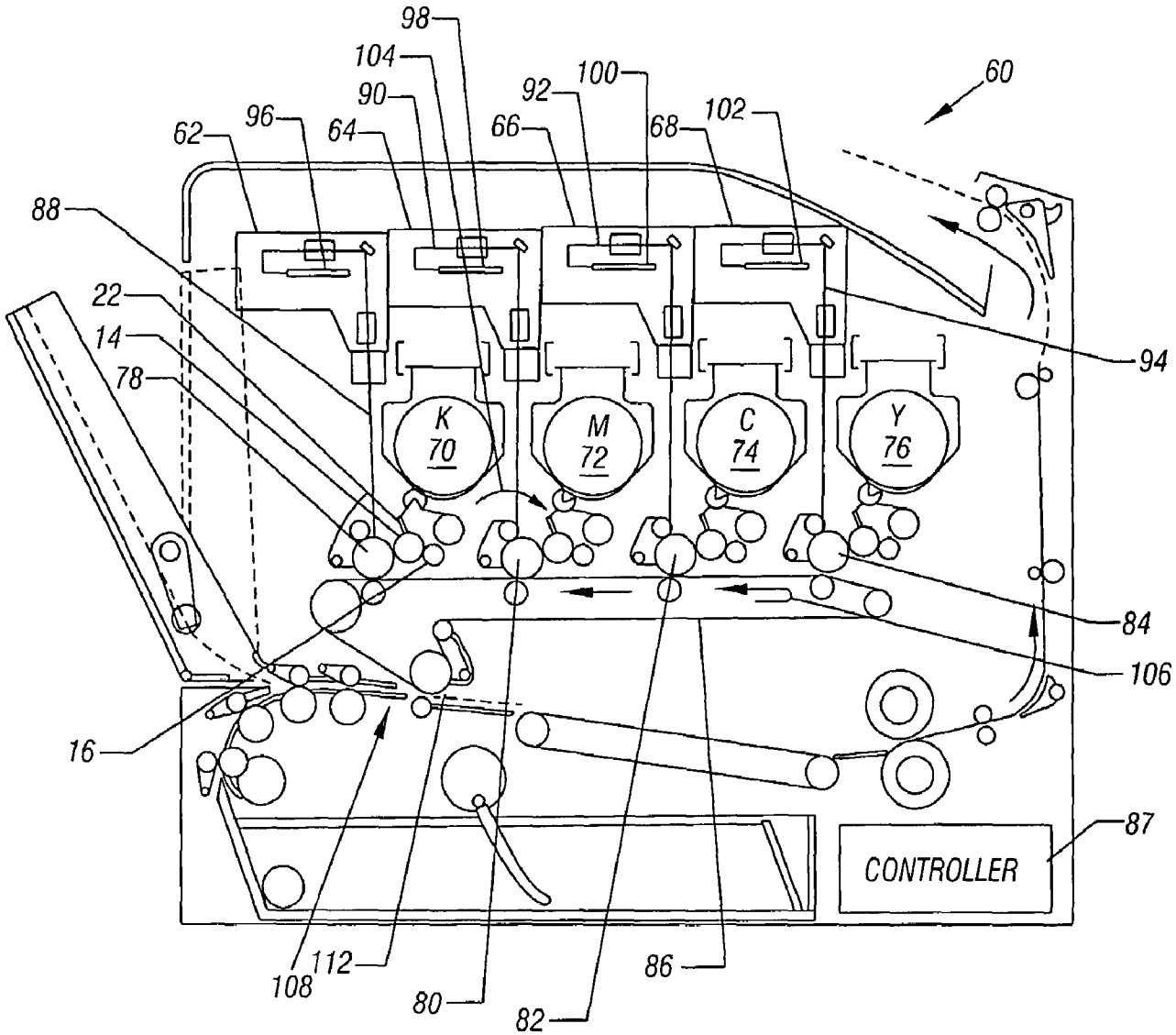
FIG. 3 is a schematic depiction of a printer in accordance with one embodiment of the present invention.

Referring to FIG. 3, there is shown one embodiment of an electro-photographic device 60 in which embodiments of the present invention may be applied. Of course the present invention is in no way limited to any specific printer design and may be applicable to a variety of different printer arrangements.

The device 60 includes laser print heads 62, 64, 66, and 68, a black toner cartridge 70, a magenta toner cartridge 72, a cyan toner cartridge 74, a yellow toner cartridge 76, photoconductive drums 78, 80, 82, and 84, an intermediate transfer belt 86, and a controller 87. In one embodiment, the controller may be a combination of application specific integrated circuits, microprocessors, and firmware suited to the tasks of printing documents.

Each of the laser print heads 62, 64, 66, and 68 projects a respective laser beam 88, 90, 92, and 94 off a respective one of the polygonal mirrors 96, 98, 100, and 102. As each of the polygonal mirrors 96, 98, 100, and 102 rotates, it scans a respective one of the reflected beams 88, 90, 92, and 94 in a scan direction, perpendicular to the plane of FIG. 3, across a respective one of the photoconductive drums 78, 80, 82, and 84.

Each of the photoconductive drums 78, 80, 82, and 84 may be negatively charged, for example, to approximately −1000 volts, and is subsequently discharged to a lower level, such as approximately −300 volts, in the areas of the peripheral surface that are impinged by a respective one of the laser beams 88, 90, 92, and 94.

During each scan of a laser beam across the photoconductive drum, each photoconductive drum 78, 80, 82, and 84 is continuously rotated, for example, in a clockwise direction, in a process direction indicated by the arrow 104. The scanning of the laser beams 88, 90, 92, and 94 across the peripheral surface of the photoconductive drums is cyclically repeated, thereby discharging the areas of the peripheral surfaces on which the laser beams impinge.

The toner in each of the toner cartridges 70, 72, 74, and 76 is negatively charged and is transported upon the surface of a developer roll 14 and biased, for example, to approximately −600 volts. Thus, when the toner for the cartridges 70, 72, 74, and 76 is brought into contact with the respective one of the photoconductive drums 78, 80, 82, and 84, the toner is attracted to and adheres to the portions of the peripheral surfaces of the drums that have been discharged to the lower voltage, say −300 volts, by the laser beams.

A doctor blade 22 may be associated with each toner cartridge 70, 72, 74, and 76. Particularly, a doctor blade 22 may be associated with each developer roll 14 which, in turn, is associated with a toner adder roll 16 and a photoconductor drum 78, 80, 82, or 84.

As the belt 86 rotates in the direction indicated by the arrow 106, the toner from each of the drums 78, 80, 82, and 84 is transferred to the outside surface of the belt 86. As a print medium, such as paper, travels along the path 108, the toner is transferred to the surface of the print medium at nip 112.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method of providing a doctor blade for providing controlled application of toner in an imaging device, the method comprising:

forming the doctor blade with a curved end portion that intersects a developer roll along a tangent, wherein the curved end portion includes a first radiused bend and an oppositely formed second radiused bend with respect to the first radiused bend.

2. The method of claim 1 including forming the doctor blade with a straight section and the curved end portion formed immediately adjacent to the straight section, wherein the curved end portion comprises of an anticlockwise radiused bend corresponding to the first radiused bend and a clockwise radiused bend corresponding to the second radiused bend.

3. The method of claim 2 including mounting said doctor blade so that said second radiused bend impacts a developer roll.

4. The method of claim 3 including securing said doctor blade so that said second radiused bend includes a surface tangential to the surface of said developer roll.

5. A doctor blade comprising:

a cantilever spring for coupling to a mounting bracket, said spring including a straight section and a free end having a first radiused bend from said straight section and a second radiused bend after said first radiused bend, said first and second radiused bends being in opposite directions.

6. The doctor blade of claim 5 wherein said free end includes a tip, said tip generally aligned with said straight section.

7. The doctor blade of claim 5 wherein said second radiused bend has a larger radius of curvature than said first radiused bend.

8. The doctor blade of claim 5 wherein said second radiused bend radius is between 0.2 mm and 1.4 mm.

9. The doctor blade of claim 5 wherein said spring is made of stainless steel.

10. The doctor blade of claim 5 wherein said free end is bump shaped.

11. A printer comprising:

a developer roll; and a doctor blade biased against said developer roll, said doctor blade including a curved end portion that intersects the developer roll along a tangent to said developer roll, wherein the curved end portion includes a first radiused bend and an oppositely formed second radiused bend with respect to the first radiused bend.

12. The printer of claim 11 further including a mounting bracket, said doctor blade comprising a cantilever spring coupled to said bracket, said spring including a straight section and a free end having the first radiused bend from said straight section and the second radiused bend after said first radiused bend, said first and second radiused bends being in opposite directions.

13. The printer of claim 12 wherein said free end includes a tip, said tip generally aligned with said straight section.

14. The printer of claim 12 wherein said second radiused bend has a larger radius of curvature than said first radiused bend.

15. The printer of claim 12 wherein said second radiused bend radius is between 0.2 mm and 1.4 mm.

16. The printer of claim 11, wherein said blade is made of stainless steel.

17. The printer of claim 12 wherein the free end includes a tip aligned with an axis of rotation of said developer roll.

18. The printer of claim 11 wherein said printer is a laser printer.

* * * * *

UNITED STATES PATENT AND TRADEMARK OFFICE

CERTIFICATE OF CORRECTION

PATENT NO. : 7,657,213 B2
APPLICATION NO. : 11/434600
DATED : February 2, 2010
INVENTOR(S) : Baker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 330 days.

Signed and Sealed this

Twenty-eighth Day of December, 2010

David J. Kappos

David J. Kappos
*Director of the United States Patent and Trademark Office*